US009144900B2

(12) United States Patent
Berman

(10) Patent No.: US 9,144,900 B2
(45) Date of Patent: Sep. 29, 2015

(54) HAND TOOL

(71) Applicant: True Brands Limited, Poole (GB)

(72) Inventor: Lee Berman, Bournemouth (GB)

(73) Assignee: True Brands Limited, Poole (GB)

( * ) Notice: Subject to any disclaimer, the term of this patent is extended or adjusted under 35 U.S.C. 154(b) by 27 days.

(21) Appl. No.: 13/855,985

(22) Filed: Apr. 3, 2013

(65) Prior Publication Data

US 2013/0263702 A1 Oct. 10, 2013

(30) Foreign Application Priority Data

Apr. 4, 2012 (GB) ..... 1206091.9

(51) Int. Cl.
*B25F 1/02* (2006.01)
*B25G 1/08* (2006.01)

(52) U.S. Cl.
CPC .. *B25F 1/02* (2013.01); *B25G 1/085* (2013.01)

(58) Field of Classification Search
CPC ..... A44B 15/00; A44B 15/005; B25F 1/02; B25G 1/08; B25G 1/085; E05B 19/00
USPC ..... 81/177.1, 177.4, 177.5, 124.7, 81/437–439; 7/165; 362/116, 120
See application file for complete search history.

(56) References Cited

U.S. PATENT DOCUMENTS 933,878 A * 9/1909 Borsch ..... 81/177.4
2,788,817 A * 4/1957 Leniz ..... 81/436
4,631,770 A * 12/1986 Goldberg ..... 7/167
4,640,155 A * 2/1987 Condon ..... 81/439
4,827,812 A 5/1989 Markovetz
4,960,016 A * 10/1990 Seals ..... 81/177.4
5,179,748 A * 1/1993 Lipic ..... 7/165
5,524,513 A * 6/1996 Barahona ..... 81/439
5,621,936 A * 4/1997 Penaligon et al. ..... 7/151
5,778,896 A 7/1998 Seals et al.
5,842,394 A * 12/1998 Hwang ..... 81/439
6,510,766 B1 * 1/2003 Lin ..... 81/177.4
7,156,002 B1 * 1/2007 Chan ..... 81/177.4
7,249,543 B1 * 7/2007 Pomerantz ..... 81/439
2006/0288531 A1 12/2006 Hu
2007/0068348 A1 * 3/2007 Schunke ..... 81/177.4
2007/0074351 A1 4/2007 Chmelar (Continued)

FOREIGN PATENT DOCUMENTS

CN 101391411 A 3/2009
GB 403769 A 1/1934

(Continued)

OTHER PUBLICATIONS

Examination Report dated Apr. 9,2014 for GB Application No. 1206091.9.

(Continued)

*Primary Examiner* — David B Thomas
(74) *Attorney, Agent, or Firm* — Thorpe North & Western, LLP

(57) ABSTRACT

A pocket hand tool comprises a tubular shank (1) with a hexagonal bore, the proximal end (1*c*) being provided with an aperture (3) and a slot (6) for receiving a bit retainer clip (4) and a coin (8)/door key (8') respectively. The clip thus serves a dual function and the slot enables the torque applied by the tool to be increased by using the coin as a handle.

23 Claims, 1 Drawing Sheet

(56) References Cited

U.S. PATENT DOCUMENTS

2009/0126538 A1* 5/2009 Miers ..... 81/177.85
2009/0282954 A1* 11/2009 Gnatz ..... 81/437

FOREIGN PATENT DOCUMENTS

KR 200185254 Y 3/2000
WO 03/038215 A1 5/2003

OTHER PUBLICATIONS

Search and Examination Report dated Jun. 13, 2014 for the divisional GB Application No. 1409194.6.
English translation of CN 101391411 A.

* cited by examiner

HAND TOOL

FIELD OF THE INVENTION

The present invention relates to a hand tool, and relates particularly but not exclusively to a pocket hand tool that can be used as a key ring attachment.

BACKGROUND OF THE INVENTION AND RELATED ART

U.S. Pat. No. 4,827,812 discloses a pocket screwdriver having a tubular shank with a distal bore portion for driving a standard removable screwdriver bit, an intermediate bore portion for storing a standard removable screwdriver bit, and a proximal portion which is closed by a torque cap. The torque cap is in the form of a rod inserted in the bore and after being removed from the bore can be inserted through diametrically opposite holes formed in the wall of the proximal portion to amplify the torque applied by the tubular shank.

However the torque cap adds significantly to the size and weight of the screwdriver and requires detent balls to retain it in the bore.

SUMMARY OF THE INVENTION

An object of the present invention is to provide a hand tool which can be miniaturised further without significantly compromising its functionality.

In one aspect the invention provides a hand tool comprising a tubular shank having a distal bore portion for driving a standard removable tool bit, a proximal end, and an intermediate bore portion for storing a standard removable tool bit, one side of the wall of the tubular shank being cut away at the proximal end and the opposite side of the wall having an aperture for receiving a bit retainer.

The bit retainer is suitably a removable clip or pin, and in a preferred embodiment is a key ring attachment, for example a quick release clip.

In this aspect the invention has the advantages that the bit retainer can be held securely in position and enables the tool to be attached to a key ring or the like, and when removed allows easy access to the stored removable tool bit.

The cut away side of the wall opposite the aperture facilitates insertion and removal of the bit retainer even when the tool is very compact.

Preferably said proximal end of the tubular shank is terminated by a plane transverse to a radial plane which transverse plane cuts away said one side of said wall. This feature facilitates insertion and removal of the bit retainer and access to the stored removable tool bit. Furthermore it reduces material wastage during manufacture, particularly if the plane is at 45° to the diametral plane.

Preferably the bit retainer is a removable clip or pin, e.g. a key ring attachment. In a preferred embodiment the bit retainer is a quick release clip.

Preferably a diametral slot is formed in the end of said proximal portion for receiving a coin or a key (particularly a flat door key such as a Yale® key). This feature enables the torque applied to the hand tool by the user to be increased by the leverage of the coin or the key. Additionally the size, weight and manufacturing cost of an integral handle are thereby avoided.

In a preferred embodiment the hand tool has a detent in said distal bore portion for retaining said standard removable tool bit.

Further preferred features are defined in the dependent claims.

In another aspect the invention provides the pocket hand tool comprising a tubular shank having a distal bore portion for driving a standard removable tool bit, a diametral slot being formed in a proximal end of the tubular shank for receiving a coin or a key. Preferably the slot is shaped and dimensioned to receive a flat door key, eg a Yale® key.

In this manner, not only can the tool be made very compact and lightweight, but also a substantial torque can be applied to a tool bit held in the distal bore portion by twisting the coin or key held in the diametral slot.

Preferably the pocket hand tool further comprises an intermediate bore portion for storing a standard removable tool bit, the bore of the tubular shank on one side of said diametral slot being cut away at said proximal end and the bore on the opposite side of said diametral slot having an aperture for receiving a bit retainer.

This feature enhances the versatility of the pocket hand tool and enables a bit retainer to secure the pocket hand tool to e.g. a key ring or the like.

Preferably said proximal end of the tubular shank is terminated by a plane transverse to a radial plane which transverse plane cuts away said wall on said one side. This feature reduces wastage during manufacture and enables the bit retainer to be inserted and removed easily.

The bit retainer is suitably a removable clip or pin, e.g. a key ring attachment, and is preferably a quick release clip as in the first aspect of the invention.

Further preferred features are defined in the dependent claims.

BRIEF DESCRIPTION OF THE DRAWINGS

A preferred embodiment of the invention is described below by way of example only with reference to FIGS. 1 to 3 of the accompanying drawings, wherein.

DETAILED DESCRIPTION OF EXEMPLARY EMBODIMENTS

Figure 1:
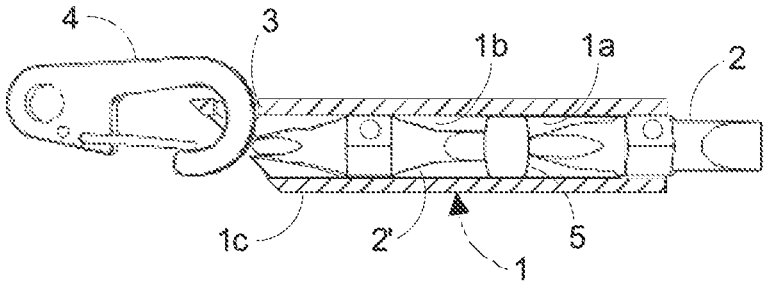
FIG. 1 is a side elevation, partially in longitudinal cross-section, of a pocket hand tool in accordance with the invention.

The pocket hand tool in FIG. 1 comprises a tubular shank 1 having a hexagonal bore. The distal end 1*a* of the hexagonal bore receives a standard double ended removable screwdriver bit 2 and an intermediate bore portion 1*b*, separated from distal end 1*a* by a plug 5, receives a further double ended hexagonal screwdriver bit 2'. The proximal end 1*c* of the tubular shank is terminated by a plane (orthogonal to the plane of the drawing) which is at 45° to a radial plane and cuts away one side of the wall of the tubular shank (the lower side in the drawing) to provide access to an aperture 3 on the other side of the wall. A quick release clip 4 is inserted through this aperture and can be used to attach the tool to a key ring or the like (not shown).

Figure 2:
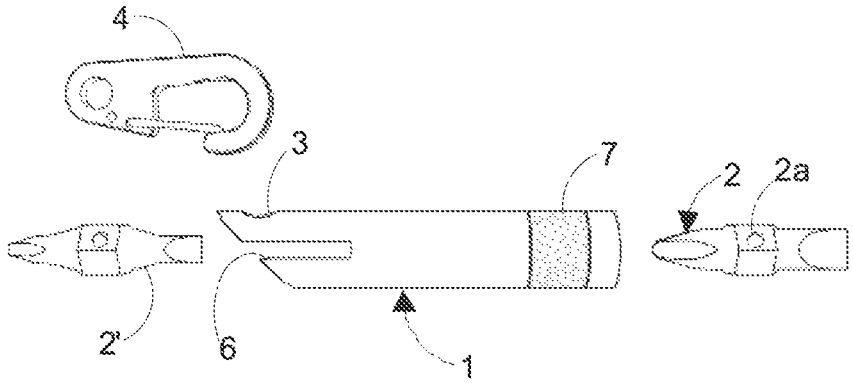
FIG. 2 is a similar side elevation, showing the pocket hand tool of FIG. 1 disassembled.

FIG. 2 shows the tool of FIG. 1 in disassembled form and it will be seen that the distal end of the tubular shank 1 is provided with an annular knurled portion 7 to facilitate gripping and guiding the tool. Each of the double ended hexagonal screwdriver bits 2 and 2' is provided with a spring loaded detent ball 2*a* which is received in a part-spherical detent recess (not shown in FIG. 2) in the bore of the tubular shank 1.

Furthermore, it will be noted that a diametral slot 6 is provided in the proximal end of the tubular shank for receiving a coin or door key.

Figure 3:
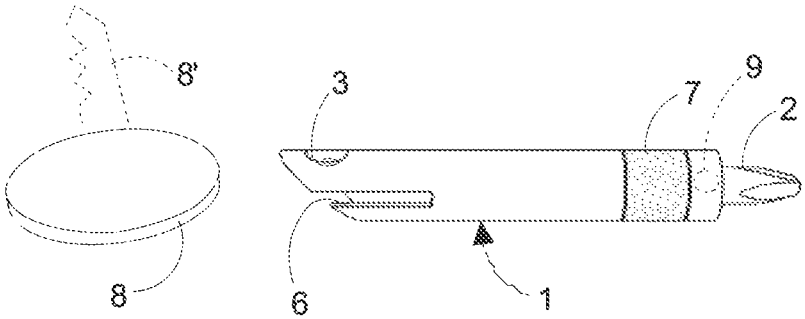
FIG. 3 is a perspective view showing the pocket hand tool of FIGS. 1 and 2 for use with a coin or a door key.

Referring to FIG. 3, a coin 8/flat door key 8' is shown and it will be seen that, when fitted into the slot 6, the periphery of the coin or the shank of the key will project some distance in the radial direction from the outside of the tubular shank and hence will function as a handle to enable the torque applied to a screwdriver bit 2 to be increased.

Any suitable clip, pin or even a wire key ring may be inserted through the aperture 3 in place of the quick release clip 4 and the screwdriver bit 2' can be easily accessed from the proximal end of the tool once the quick release clip 4 or other bit retainer is removed. To facilitate this, the plug 5 may be slideable rather than securely fixed within the bore of the tubular shank 1, enabling the tool bit 2 to be pressed in to the bore to force the plug 5 against the end of the further removable tool bit 2' and eject it from the proximal end of the bore.

Preferably the bits 2, 2' are screwdriver bits with different screwdriver heads at each end, e.g. flat bladed, Phillips, or torx heads. Optionally, a hexagonal bit driver may be provided for insertion into the distal bore portion 1*a* in order to increase the length of the tool.

Although the termination of the proximal end of the tubular shank 1 is conveniently planar as shown in the drawings, this is not essential, and the lower portion of the wall (as shown in FIG. 1) can be cut away in other forms.

In other embodiments in accordance with the second aspect of the invention, the lower portion of the wall at proximal end 1*c* need not be cut away and indeed the aperture 3 could be omitted.

In further embodiments in accordance with the second aspect of the invention, the intermediate bore portion 1*b* for storing a further tool bit could be omitted. Alternatively, in yet further embodiments, the tubular shank 1 could be extended to enable more than one replacement tool bit 2, 2' to be stored in the intermediate bore portion.

The invention claimed is:

1. A hand tool comprising a tubular shank having a distal bore portion for driving a removable tool bit, a proximal end, and an intermediate bore portion for storing a removable tool bit, wherein the proximal end of the tubular shank is terminated by a plane transverse to a radial plane of the tubular shank, and wherein a side wall of said proximal end comprises an aperture configured to receive a bit retainer therein.

2. A hand tool according to claim 1, further comprising a bit retainer extending across a portion of the bore at said proximal end and through said aperture.

3. A hand tool according to claim 2, wherein said bit retainer is a removable clip or pin.

4. A hand tool according to claim 2, wherein said bit retainer is a key ring attachment.

5. A hand tool according to claim 2, wherein said bit retainer is a quick release clip.

6. A hand tool according to claim 1, wherein a diametral slot extending across the plane transverse to the radial plane of the tubular shank is formed in the proximal end of the tubular shank.

7. A hand tool according to claim 1, having a detent in said distal bore portion for retaining said removable tool bit.

8. A hand tool according to claim 1, further comprising a first removable tool bit in said distal bore portion and a second removable tool bit, different from said first removable tool bit, in said intermediate bore portion.

9. A hand tool according to claim 8, wherein said removable tool bits are double-ended.

10. A hand tool according to claim 1, wherein the outer periphery of said tubular shank is provided with a gripping surface.

11. A hand tool according to claim 10, wherein said gripping surface is a knurled surface portion.

12. A pocket hand tool comprising:

a tubular shank having a distal bore portion for driving a removable tool bit, wherein the tubular shank comprises a side wall;

a diametral slot being formed in a proximal end of the tubular shank, said diametral slot configured for receiving a planar torque member therein; and a detent in said distal bore portion for retaining said removable tool bit.

13. A pocket hand tool according to claim 12, wherein the side wall of the tubular shank on one side of said diametral slot has an aperture for receiving a bit retainer.

14. A pocket hand tool according to claim 13, wherein said proximal end of the tubular shank is terminated by a plane transverse to a radial plane of the tubular shank.

15. A pocket hand tool according to claim 13, further comprising a bit retainer extending across a portion of the bore of said proximal portion and through said aperture.

16. A pocket hand tool according to claim 15, wherein said bit retainer is a removable clip or pin;

a key ring attachment; or a quick release clip.

17. A pocket hand tool according to claim 13, further comprising a first removable tool bit in said distal bore portion and a second removable tool bit, different from said first removable tool bit, in said intermediate bore portion.

18. A hand tool according to claim 12, wherein the outer periphery of said tubular shank is provided with a gripping surface.

19. A hand tool according to claim 18, wherein said gripping surface is a knurled surface portion.

20. A hand tool, comprising:

a tubular shank comprising a circular side wall, said shank housing at least one tool bit in a distal end of said shank;

wherein a proximal end of the tubular shank is terminated at an angle transverse to a radial plane of the tubular shank; and a diametral slot disposed in a proximal end of the tubular shank, said diametral slot extending across opposing side walls of the tubular shank.

21. The hand tool of claim 20, further comprising an aperture disposed in a side wall of the tubular shank at a proximal end of the tubular shank.

22. The hand tool of claim 21, further comprising a bit retainer coupled to the hand tool through the aperture.

23. The hand tool of claim 20, wherein the diametral slot comprises an axis that is substantially parallel to a longitudinal axis of the tubular shank.

* * * * *